United States Patent [19]

Huang

[11] Patent Number: 4,833,007

[45] Date of Patent: May 23, 1989

[54] MICROWAVE SUSCEPTOR PACKAGING MATERIAL

[75] Inventor: Hua-Feng Huang, Mendenhall, Pa.

[73] Assignee: E. I. Du Pont de Nemours and Company, Wilmington, Del.

[21] Appl. No.: 37,988

[22] Filed: Apr. 13, 1987

[51] Int. Cl.[4] ..... B32B 5/16

[52] U.S. Cl. ..... 428/242; 428/283; 428/328

[58] Field of Search ..... 428/242, 283, 328

[56] References Cited

U.S. PATENT DOCUMENTS

| | | | |
|---|---|---|---|
| 2,923,934 | 2/1960 | Halpern | 343/18 |
| 2,951,246 | 8/1960 | Halpern et al. | 343/18 |
| 2,951,247 | 8/1960 | Halpern et al. | 343/18 |
| 3,007,160 | 10/1961 | Halpern | 343/18 |
| 4,230,924 | 10/1980 | Bradstad et al. | 219/10.55 E |
| 4,266,108 | 5/1981 | Anderson et al. | 219/10.55 E |
| 4,267,420 | 5/1981 | Brastad | 219/10.55 E |
| 4,316,070 | 2/1982 | Prosise et al. | 219/10.55 E |
| 4,434,197 | 2/1984 | Petriello et al. | 427/407.1 |
| 4,518,651 | 5/1985 | Wolfe, Jr. | 428/308.8 |
| 4,641,005 | 2/1987 | Seiferth | 219/10.55 E |

FOREIGN PATENT DOCUMENTS

| | | |
|---|---|---|
| 90432 | 10/1983 | European Pat. Off. . |
| 3146235 | 5/1983 | Fed. Rep. of Germany . |
| 60-018340 | 1/1985 | Japan . |

*Primary Examiner*—Marion C. McCamish

[57] ABSTRACT

New composite materials useful for wrapping food items to be cooked by microwave energy comprise a dielectric substrate substantially transparent to microwave energy which substrate is coated and/or imbibed with one or more microwave susceptor materials, the type and amount of said susceptor material or materials being adequate to allow said materials to absorb a portion of both the electric and the magnetic field components of said microwave energy and convert said energy to heat to rapidly brown or crispen the surface of the food item adjacent thereto without substantially impeding the ability of the microwave energy to penetrate the susceptor material and cook the food item.

19 Claims, 3 Drawing Sheets

MICROWAVE SUSCEPTOR PACKAGING MATERIAL

BACKGROUND OF THE INVENTION

This invention relates to materials useful for enhancing the browning and crispening and/or for providing uniform heating of foods cooked in microwave ovens.

Food preparation and cooking by means of microwave energy has, in recent years, become widely practiced as convenient and energy efficient. Microwave cooking of precooked and uncooked food products has traditionally produced bland-appearing and soggy meats and pastry goods. To alleviate this problem and aid the browning and crispening of the surface of a cooked food item, there have been developed a number of packaging materials specially adapted for use in microwave cooking. Many such known packaging materials incorporate a microwave susceptor material, i.e., a material capable of absorbing the electric or magnetic portion of the microwave field energy to convert that energy to heat. The susceptor material generally heats the adjacent surface of the food by conduction to a sufficiently high temperature to crispen or scorch the surface while direct microwave exposure of the food heats the interior.

U.S. Pat. No. 4,267,420 to Brastad discloses a packaging material which is a plastic film or other dielectric substrate having a thin semiconducting coating. A food item is wrapped in the coated film so that the film conforms to a substantial surface portion of the food item. On exposure to microwave energy, the film converts some of that energy into heat which is transmitted directly to the surface portion so that a browning and/or crispening is achieved.

U.S. Pat. No. 4,518,651 to Wolfe discloses flexible composite materials exhibiting controlled absorption of microwave energy comprising a porous dielectric substrate coated with electrically conductive particles, such as particulate carbon, in a thermoplastic dielectric matrix. The porous substrate is a sheet or web material, usually paper or paperboard.

U.S. Pat. No. 4,434,197 to Petriello et al. discloses a flexible multi-layer structure having at least one layer colored with a pigment and/or energy absorber with the outer two layers consisting of pure polytetrafluoroethylene to provide a food contacting surface. Disclosed as suitable energy absorbers are colloidal graphite, carbon and ferrous oxide.

U.S. Pat. No. 4,230,924 to Brastad et al. discloses a flexible wrapping sheet of dielectric material, such as polyester or paperboard, capable of conforming to at least a portion of the shape of a food article, and having a flexible metallic coating thereon. The coating, e.g., of aluminum, chromium, tin oxide, silver or gold, converts a portion of microwave energy into thermal energy so as to brown or crispen that portion of the food adjacent thereto.

The above-mentioned patents are only a few of the many patents disclosing the use of susceptor materials to aid in the browning and crispening of foods cooked by microwave energy. One problem which the known art does not address is the uneveness of cooking and/or browning that can occur in a microwave oven as a result of position-to-position electric and magnetic field strength variations in the oven. These field strength variations derive from an assortment of standing waves at the different modal wavelengths that exist in the enclosed oven cavity due to the interference between forward-going and reflected waves. The locations of these interferences (or "hot" or "cold" spots) vary not only between ovens of different manufacturers, but vary between ovens of the same manufacturer and by the position, type, and amount of food exposed to the electromagnetic fields. Also, as microwave ovens become smaller and more compact, the problems of uneveness will increase since the number of standing wave modes available for averaging are less and the microwave power density in the oven cavity becomes higher. Therefore, the difference between the "hot" spot and the "cold" spot temperatures become more intense in a smaller cavity.

It is therefore an object of this invention to ameliorate the inherent uneveness of response to the electric and magnetic fields in a microwave oven and to provide a composite susceptor material capable of affording uniform and consistent heating and browning of a food item by microwave energy independent of its placement within the microwave oven.

SUMMARY OF THE INVENTION

New composite materials have now been found for packaging food items which are effective for providing uniform heating and browning of those food items during microwave cooking. These new composite materials comprise a dielectric substrate substantially transparent to microwave radiation in combination with a susceptor material or materials which is (are) responsive to both the electric and magnetic fields of the microwave radiation. Such "dual-responsive" or "dual-mode" susceptors can be mixtures of electrically conductive and magnetically permeable materials, can be alloys of electrically conductive and magnetic metals, and can be electrically conductive, non-magnetic materials or certain naturally occurring food substances. The amount of the susceptor material(s) must be adequate to allow said materials to absorb a portion of both the electric and the magnetic components of said microwave energy and convert said energy to heat to rapidly brown or crispen the surface of the food item adjacent thereto without substantially impeding the ability of the microwave energy to penetrate the susceptor material and cook the food item.

DETAILED DESCRIPTION OF THE INVENTION

Figure 1:
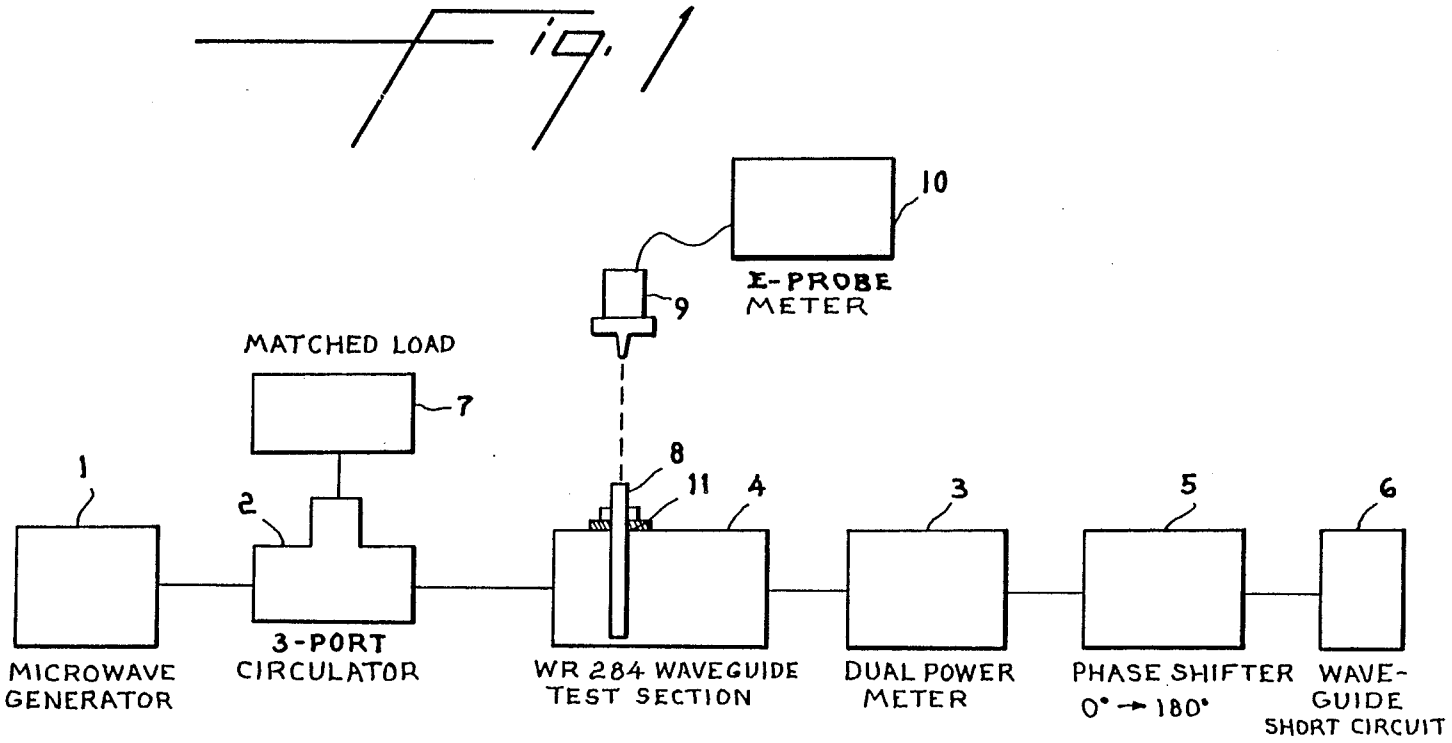
FIG. 1 illustrates a waveguide system useful for measuring the heating responses of composite materials of this invention to an electric field standing wave maximum parallel to the surface of such composite materials and to a magnetic field maximum perpendicular to the surface of such materials.

The substrate materal used in this invention is a carrier web or film which has sufficient thermal and dimnnsional stability to be useful as a packaging material at the high temperatures which may be desired for browning or rapidly heating foods in a microwave oven (generally, as high as 110 degrees C. and above). Polymeric films, including polyester films, such as polyethylene terephthalate films, and polymethylpentene films, and films of other thermally stable polymers such as polyarylates, polyamides, polycarbonates, polyetherimides, polyimides and the like can be used. Liquid permeable substrate materials which allow liquids evolved during cooking of the food to escape, to couple with the incident electromagnetic field and to rapidly evolve as vapor to the environment as the susceptor heats up are preferred as they enhance browning and crispening. Such liquid permeable materials include the woven or non-woven, fibrous substrates disclosed in copending U.S. Ser. No. 07/037,987 filed simultaneously herewith, the disclosure of which is hereby incorporated by reference. Examples of such liquid permeable, woven or nonwoven, fibrous substrates include materials made from cotton, cellulose, jute, hemp, acetate, fiberglass, wool, nylon, polyester, aramid, polypropylene and other polyolefins. Preferred substrates are cotton, paper and fiberglass fabrics.

The keys to this invention are, first, the choice of susceptor material and, second, the amount of susceptor used. As previously indicated, susceptor materials are materials which are capable of absorbing the electric or magnetic portion of the microwave field energy to convert that energy to heat. To achieve the desired consistency and uniformity of response independent of its location or placement in the oven, the susceptor material used in the composite materials of this invention should be responsive to both the electric and magnetic fields of the microwave radiation, i.e., capable of absorbing a portion of both the electric and the magnetic field energy and converting them to heat. Furthermore, for best results, the heating response (i.e., the temperature which the material attains on exposure to microwave energy for a given period of time) of the susceptor material upon exposure to the electric field standing wave maximum in any given standing wave mode parallel to its surface should be similar to the heating response of the material on exposure to the magnetic field standing wave maximum in the same standing wave mode perpendicular to its surface.

The reason for requiring similar heating responses to both the electric field standing wave maximum parallel to the susceptor surface and the magnetic field standing wave maximum perpendicular to the susceptor surface is as follows. In a given standing wave mode, the electric field maximum parallel to the surface of the composite susceptor material falls on the magnetic field minimum perpendicular to the same surface. Conversely, in the same standing wave mode, the magnetic field standing wave maximum perpendicular to the composite susceptor material surface falls on the electric field minimum parallel to the same surface. A susceptor capable of responding to the electric field component of the microwave energy will exhibit its greatest heating response at the electiic field standing wave maximum parallel to the susceptor surface. A magnetically permeable metallic susceptor capable of responding to the magnetic field component of the microwave energy will exhibit its greatest heating response at the magnetic field standing wave maximum that is oriented perpendicular to the susceptor surface. Thus, to avoid the effects of "hot" and "cold" spots, it is desirable that the susceptor material exhibit similar heating responses at both "maxima". Furthermore, since it is believed that most foods heat predominately by absorption of the electric field component, it may be desirable to select a susceptor material that exhibits a slightly greater heating response for the perpendicular magnetic field standing wave maximum than for the parallel electric field standing wave maximum. Such a selection would compensate for the additional heating of the food surface that the food itself provides by virtue of its own response to the electric field component of the microwave energy.

The preferred susceptor materials of this invention, when exposed for a given time period of between fifteen seconds and four minutes to a magnetic field standing wave maximum of 0.521 ampere/cm root mean square oriented perpendicular to their surfaces, heat to a temperature $T_H$, and when exposed for the same time period to an electric field standing wave maximum of 242 volts/cm root mean square oriented parallel to their surfaces, heat to a temperature $T_E$, where $((T_H-T_E)/T_E)*100\%$ is in the range from about $-10$ to $+100\%$, preferably in the range of from about $-10$ to $+60\%$. TE is preferably at least 110 degrees C. The field intensity values above specified (0.521 ampere/cm and 242 volts/cm) are in the mid-range of the field intensities in commercially available microwave ovens.

One way to obtain a susceptor material which is responsive to both the electric and magnetic microwave field components is to utilize as the susceptor a combination of materials, at least one of which is responsive to the electric field oriented parallel to its surface and at least one of which is responsive to the magnetic field oriented perpendicular to its surface. For example, in one preferred embodiment, the susceptor may be an alloy of metals, which alloy contains both electrically conductive and magnetic metals. Many electrically conductive metals are known, for example, copper, aluminum, silver, gold, platinum and zinc. Magnetically permeable metals include iron, cobalt and nickel. Examples of suitable alloys include but are not limited to stainless steel (iron, chromium, nickel alloy), nickel/iron/molybdenum alloys such as Permalloy, nickel/iron/copper alloys such as Mu-metal, and iron/nickel alloys such as Hypernick. Table 1 provides information regarding the composition of some of the preferred alloys for use in this invention.

TABLE 1

| | Metal Alloys Useful as Susceptors | | | |
|---|---|---|---|---|
| Metal COMPOSITION (%) | Stainless Steel SS304 | Stainless Steel SS316 | Permalloy 4-79 | Mu-Metal |
| C | 0.08 | 0.08 | | |
| Mn | 2 | 2. | 0.3 | |
| P | 0.045 | 0.045 | | |
| S | 0.03 | 0.03 | | |
| Si | 1.0 | 1.0 | | |
| Cr | 18./20. | 16./18. | | 2. |
| Ni | 8./12. | 10./14. | 79. | 75. |
| Mo | | 2./3. | 4. | |
| Cu | | | | 5. |
| Fe | balance | balance | balance | balance |

Tabulated from CRC Handbook of Chemistry and Physics, 55th Ed.

As an alternative to using a metal alloy as the susceptor material, one could use a mixture of electrically conductive and magnetically permeable materials. For example, one might combine electrically conductive materials such as aluminum flakes with magnetically permeable materials such as Permalloy flakes in a single coating, or might interleaf separate coatings of such materials.

Finally, a dual mode response can be achieved using solely electrically conductive, non-magnetic materials as the susceptor material of this invention. A conductive material, when exposed to an oscillating magnetic field perpendicular to its surface, is capable of generating eddy currents which in turn generate heat provided the layer of conductive materials is of an appropriate thickness. To obtain the heating responses desired for this invention, i.e., heating responses similar in both the E and H fields, one must adjust the thickness of the layer of conductive material to balance the magnetic field-induced eddy current heating with the heating of the susceptor by virtue of absorption of electric field energy per se.

In one preferred embodiment, the susceptor material is a conductive metal, such as aluminum, and is in flake form as disclosed in copending application U.S. Ser. No. 002,980, filed Jan. 23,1987, the disclosure of which is hereby incorporated by reference. As that application discloses, the flake susceptor material (having a ratio of the largest dimension of its face to its thickness of at least about 10) may be dispersed in a thermoplastic dielectric matrix, e.g., a polyester copolymer. The susceptor level in the thermoplastic matrix will generally range from about 5 to 80% by weight of the combined susceptor/matrix. A solution of the susceptor/matrix may be applied to the substrate material by any number of coating or printing processes, e.g., as by gravure printing. To achieve best results, the susceptor coating should be uniform and isotropic.

Surprisingly, certain naturally occuring food substances are useful as microwave susceptors, and, when applied in optimum thickness to a dielectric substrate, respond to both the electric field components parallel to and magnetic field components perpendicular to their surfaces. Examples of such naturally occuring food substances which can be used as a susceptor according to this invention are molasses and maple syrup.

To obtain the desired similar heating responses with both the electric field parallel and magnetic field perpendicular components, the amount of susceptor utilized is critical. It is impossible, however, to generalize as to an appropriate amount for all susceptors as those amounts will vary from susceptor to susceptor.

Table 2 presents data showing varying electric field parallel (E ||) and magnetic field perpendicular (H⊥) heating responses for several other composite materials of this invention, and these data illustrate the degree to which E || and H⊥ field heating responses are dependent upon the amount of susceptor in or on the composite material. In Table 2, $T_E$ is the tempeaature of the composite materials in degrees C. after exposure to a parallel electric field (E ||) strength of 242 V/cm for four minutes, and $T_H$ is the temperature of the composite materials in degrees C. after exposure to a perpendicular magnetic field (H⊥) strength of 0.521 amp/cm for four minutes.

TABLE 2

| Composite | Susceptor Thickness % VLT* | $T_E$ | $T_H$ | $(T_H - T_E)/T_E$ Percent |
|---|---|---|---|---|
| Stainless | 14 | 134 | 183 | +36.6 |
| Steel 304 | 8 | 156 | 238 | +52.6 |
| on Coarse | 2 | 167 | 233 | +39.5 |
| Cotton Fabric | | | | |
| Mu-Metal | 14 | 288 | 335 | +16.3 |
| on | 8 | 251 | 340 | +35.5 |
| Fiberglass | 2 | 232 | 314 | +35.4 |
| Fabric | | | | |
| Stainless | 14 | 188.6 | 245.8 | +30.3 |

TABLE 2-continued

| Composite | Susceptor Thickness % VLT* | $T_E$ | $T_H$ | $(T_H - T_E)/T_E$ Percent |
|---|---|---|---|---|
| Steel 304 | 8 | 176.9 | 232.6 | +31.5 |
| on Fine | 2 | 176.8 | 200.3 | +13.3 |
| Cotton | 1 | 156.4 | 187.6 | +20.0 |
| Fabric | 0.5 | 165.0 | 228.3 | +38.4 |

*Substrates were vacuum metallized; the amount of coating was equivalent to that required to achieve a vacuum metallized 92 gage thick polyester film with the indicated Percent Visible Light Transmission (% VLT).

The quantity of susceptor applied to the substrae should be sufficient to rapidly raise the temperature of the composite material to temperatures which will aid the browning and crispening of the adjacent food surface but should also not substantially impede the ability of microwave energy to penetrate into the food item being cooked. In other words, food items wrapped in the composite materials of this invention should be capable of being cooked, browned and/or crispened by microwave energy in substantially less time than it would take to cook the same item in a conventional oven. Controlling the thickness of the susceptor in relation to the microwave skin depth in the composite at microwave frequencies allows a proper balance between reflection, absorption, and transmission of electromagnetic energy at or near the food surface. This optimizes the surface heating for crisping and browning as well as the amount of microwave energy transmitted through the composite material so as to avoid over or under cooking of the interior portion of the food. The amount of susceptor coated on or imbibed in the substrate will generally be an amount equivalent to or less than about twice the microwave skin depth.

Various methods may be used to measure the amount of susceptor coated on or imbibed in the substrate material to form the composites of this invention. No one method is suitable for quantifying the amount of susceptor used in all of the composites of this invention, however. To quantify the amount of metal coated on a film, for example, D.C. surface resistivities are commonly used. Direct surface resistivity measurements cannot be used to quantify the amount of susceptor coated onto one side of certain of the preferred fibrous substrates of this invention, e.g., woven cotton, since, by virtue of the open spaces between the fibers, the coating layer is not continuous. On the other hand, if the woven fibrous substrate (or fibers thereof prior to weaving) had been immersed in the susceptor material, so that the fibers are imbibed with or completely coated with susceptor material, it would be possible to directly measure the surface resistivity of the composite material.

Two methods of quantifying the amount of susceptor in or on a substrate have been used in those instances where direct surface resistivities cannot be measured. In both of these methods, measurements are made on polyester film coated with an amount of susceptor equivalent to that on the fibruus substrate. One method measures the amount of visible light transmitted through 92 gauge polyester film coated with susceptor, and the other measures the surface resistivity of polyester film coated with susceptor. Thus, for example, one can quantify the amount of susceptor on a fibrous substrate by equating it to the amount of susceptor which will, when coated onto polyester film, lead to a film with a certain specified Percent Visible Light Transmission (%

VLT) or surface resistivity. A third method useful in some instances for determining the amount of susceptor on a substrate involves the use of a Quartz Oscillator Thickness gauge, where the frequency of vibration changes with the amount of metal deposited onto the substrate.

The susceptor materials may be in the form of a coating on the surface of the substrate or may actually be imbibed in the substrate, and a number of methods may be used to apply the susceptor materials to the substrate. When the substrate is a woven or nonwoven fibrous substrate, the susceptor may be applied directly to the fibers from which the substrate will be made, e.g., in the extrusion process or later as a finish application prior to weaving or forming into substrate materials. In the case of substrates made from synthetic fibers, the susceptor may be imbibed in the polymer spinning solution before the solution is spun into fiber. Alternatvvely, the susceptor may be applied to the substrate cloth or film itself using methods including but not limited to vacuum chemical vapor deposition, immersion, vacuum metallization, RF sputtering, printing and electrolytic processes or baths. It is believed that, when a fibrous substrate is used, the heating capacity of the composite material is enhanced when individual fibers are treated with the susceptor material (in contrast with fiber bundles or the finished substrate material itself) because of the increased coated surface area. Enhanced heating capacity should lead to more rapid and better controlled heating and browning of the surface of the wrapped food item.

Guidelines that establish which heating rates and thermal equilibrium limits are appropriate for wrapping a particular food stuff are dependent upon microwave oven heating power, the type of microwave oven, the state of the foodstuff (e.g., frozen, refrigerated, dry) and the softening point, if any, of the substrate portion of the composite material. It has been found that some of the composite materials of this invention may be repeatedly used as food wraps for exposure in microwave ovens.

To measure the heating responses of composite materials of this invention to electric field standing wave maximum parallel and magnetic field standing wave maximum perpendicular to their surfaces, a non-resonant 2450 MHz waveguide system as illustrated in FIG. 1 can be used. The system comprises a microwave generator 1 (typically a Gerling Labs GL103A) that feeds 2450 MHz microwave power through a microwave three-port circulator 2 (typically a Gerling Labs GL401A) into a WR 284 rectangular waveguide test section 4 (typically a Gerling Labs GL301-1). (WR 284 is a rectangular waveguide with an interior cross-section of 7.2 cm by 3.4 cm.) The waveguide test section 4 is modified by boring an aperture 11 through a wide wall to receive sample-probe assembly 8. The output port of waveguide test section 4 is connected in seriatum to dual power meter 3 (typically a Gerling Labs GL 204), waveguide phase shifter 5 and to waveguide short circuit 6 (obtainable from Gerling Laboratories, Modesto, California). The reflected wave from short circuit 6 establishes a pure electric field standing wave maximum that is parallel to the sample surface at the probe position and a pure magnetic field standing wave maximum g/4 away (g/4 being a guided wavelength). A pure standing wave will be formed in the waveguide test section 4 as long as the sample perturbation is small and the reflected energy is completely dissipated by the matched load termination 7 which is connected to the remaining port of microwave circulator 2. The matched termination 7 prevents microwave energy from making a third and successive pass through waveguide test section 4. Phase shifter 5 is used to position the respective E-field and H-field standing wave maxima under aperture 11 for measurement.

Figure 2:
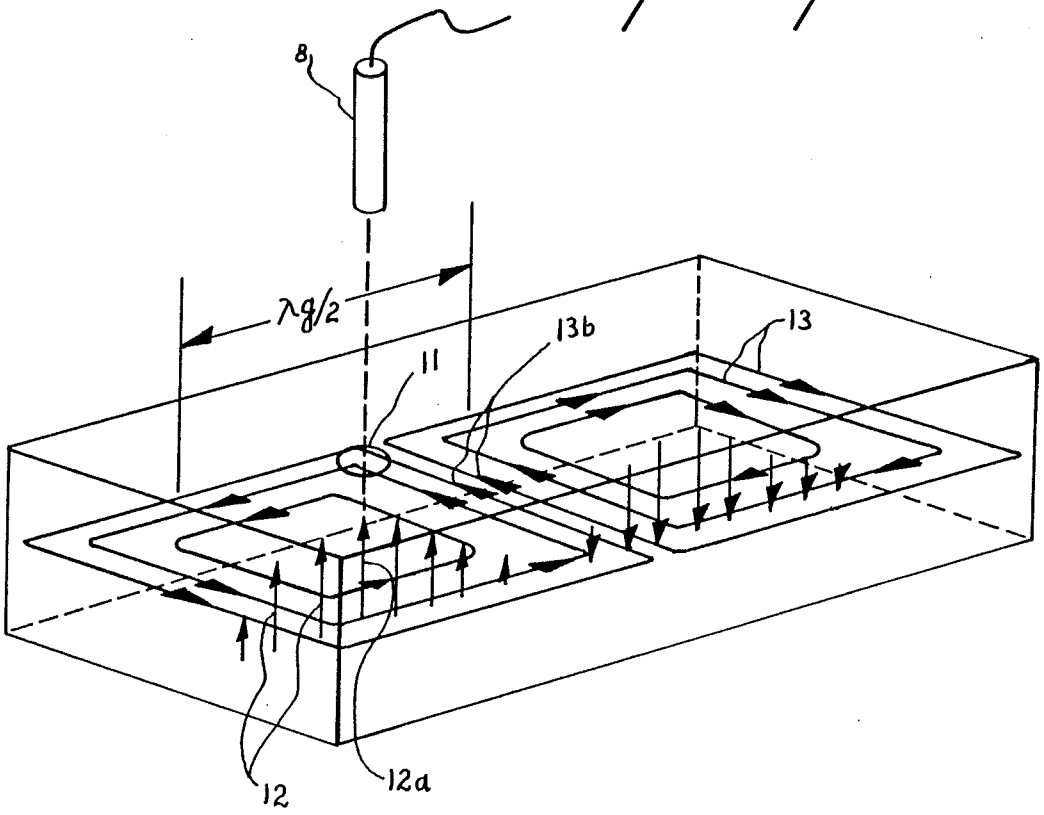
FIG. 2 illustrates the standing wave pattern in the rectangular waveguide section of FIG. 1.

FIG. 2 illustrates a single mode standing wave pattern in rectangular wavegide test section 4. The vertical arrows 12 represent the strength and direcion of the electric field along the longitudinal waveguide axis. The pattern further shows the electric field standing wave maximum 12*a* positioned coaxially with aperture 11. The corresponding magnetic field strength and direction is represented by the horizontal loop spacing and arrow direction 13. The closrr the loop spacing, the stronger the field. Although the arrow directions (polarities) of both E- and H-fields reverse periodically with time, the pattern's spatial position remains fixed, unless modified by phase shifter 5. It is important to note that a quarter wavelength away from the E-field standing wave maximum (where $|E|=0$), the magnetic field standing wave maximum (indicated by the two codirectional long segments at point 13*b*) orientation is normal to the electric field pattern. Furthermore, both E-field and H-field standing wave maxima can be measured at the same location 11 by changing the setting of phase shifter 5 through a quarter wavelength without disturbing their orientations. Thus, probe 8, when in place in aperture 11, can measure both E-parallel and H-perpendicular standing wave maxima.

Figure 3:
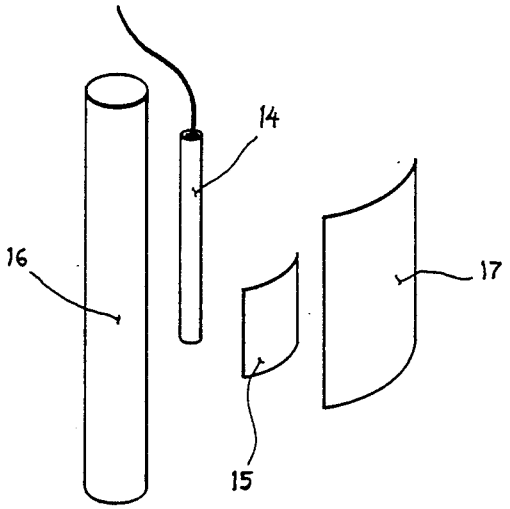
FIG. 3 illustrates a sample-probe assembly for use in the system illustrated in FIG. 1.

The sample-probe-assembly 8 is shown in greater detail in FIG. 3. A Luxtron Fluoroptic temperature probe 14 is sandwiched between a 1-cm by 2-cm sample of composite material 15 and a 5 mm diameter polytetrafluroethylene rod 16. The probe-composite assembly is secured to the rod by a Teflon® polytetrafluoroethylene tape 17. To measure parallel electric field heat generation of a sample, one first inserts an electric field coaxial probe with crystal detector 9 as shown in FIG. 1 through aperture 11 and adjusts phase-shifter 5 until the E-probe meter 10 indicates a peak. This is done to make sure the sample-probe assembly 8 will be exposed to a pure electric field standing wave maximum. Next, sample-probe assembly 8 is inserted into aperture 11 so that the center surface of the composite material 15 faces the incoming microwave power from the three port circulator 2. The temperature versus time electric-field parallel heating profile for a sample can then be recorded over a period of several minutes. For measuring perpendicular magnetic field heat generation, the phase shifter 5 is again adjusted, but this time to obtain an E-probe meter minimum reading when the electric field coaxial probe 9 is in aperture 11. Finally, sample-probe assembly 8 is inserted in the aperture 11 in the same manner for recording the temperature versus time magnetic field-perpendicular heating profile, but this time the center surface of composite material 15 is positioned to face the narrow wall of waveguide section 4.

Excitation of waveguide test section 4 for the foregoing measurements was regulated using power meter 3 to obtain typical oven electric and magnetic field strengths. The latter were derived from separate empirical measurements of temperature versus time responses of strictly electric field susceptive material, e.g., bakelite strips, and strictly magnetic field susceptive material, such as Ni/Zn ferrite power C/5N that were positioned at their respective E- and H-field oven "hot" spots. The strip of electric field susceptive material was oriented in a plane parallel to and about 3 cm above the oven bottom, while the magnetic field susceptor material (placed in a 4 mm quartz tube) was positioned on and oriented perpendicular to this plane. A Luxtron probe positioned in that plane was used to measure the temperature versus time response of the susceptor. The temperature versus time of the hot spot was subsequently reproduced with the non-resonant 2450 MHz waveguide system in order to determine the respective forward power reading needed to simulate the electric-field hot spot intensity or the magnetic-field hot spot intensity. Table 3 lists the microwave generator 1 power levels that were applied to simulate E- and H-field hot spot field strengths which closely replicate the temperature-time responses of the three microwave oven settings tested.

TABLE 3

| Oven Power Setting | E ‖ Field Forward Power (Watts) | E ‖ Field Strength (V/cm) | H ⊥ Field Forward Power (Watts) | H ⊥ Field Strength (Amp/cm) |
|---|---|---|---|---|
| low | 148 | 185.4 | 363 | 0.408 |
| medium | 254 | 242.6 | 593 | 0.521 |
| high | 725 | 410 | 1648 | 0.869 |

The ratio of E-field hot spot intensity to H-field hot spot intensity at the low and high oven power settings are within ±3% of the same ratio at the medium power setting.

To use the composite materials of this invention, one generally wraps a food item to be cooked in the composite material in such a way that the composite material conforms substantially to the shape of the food item and is substantially in contact with that portion of the surface of the food item which is desired to be browned and/or crispened. (In some applications, such as when the food item itself is adjusted to also be microwave susceptive, it may only be desired to place the composite material over the food item rather than wrap the entire food item in the material. The composite material then provides a hot surrounding to prevent moisture cnndensation.) The wrapped food item is then exposed to microwave energy. The susceptor material in or on the composite converts a portion of the microwave energy to heat and heats the adjacent surface of the food item by conduction to a sufficiently high temperature to crisp or scorch it. In the meantime, the transmitted microwave energy heats the interior of the food item.

Applications of the composites of this invention are illustrated in the following examples. Unless otherwise indicated, the microwave ovens used in the cooking experimentation described in the examples were nominal 700 watt, one cubic foot ovens. The waveguide system as described above and shown in FIG. 1 was used to measure the E ‖ and H⊥ heating responses of the composite materials tested.

EXAMPLE 1

Frozen "shrimp" egg rolls (approximate size 1¼"×¾" crossection, 1¾" long, made by JENO's, Inc., Casselbery, FL) are sold with instructions for "conventional oven heating" (10 minutes at 425 deg. F.) or "hot oil" deep frying (2½ minutes at 400 deg. F.). Cooking for 12 minutes at 375 deg. F. in a convnntional oven produces medium flat, slightly crispy egg rolls.

Egg rolls were wrapped with a composite material of this invention: "Kevlar" aramid fabric, Type S-281 (E.I. du Pont de Nemours and Company) coated by radio frequency sputtering with "Permalloy", Ni-84/Fe-16 (atomic percent), with various thicknesses as measured using the quartz crystal oscillator gauge method. Each wrapped egg roll was hung on a string from the ceiling of the oven and allowed to rotate by itself while cooking for 45 seconds to 1 minute with full microwave power. This procedure consistently produced browned, crisped, and full (round cross section) egg rolls. The equivalent "Permalloy" deposition thicknesses of 250 angstroms to 2000 angstroms all gave good results over a range of levels of browning and crispening. Some burning may occur should spinning stop as the "hot" spot temperature can exceed 200 degrees C. with this composite material. The typical surface temperature for uniform browning and crisping for an egg roll is 130 degrees C.

EXAMPLE 2

Frozen fish sticks (Mrs. Paul's "Crunchy Light Batter, Mild and Flaky" Fish Sticks, Mrs. Paul's Kitchen, Inc., Philadelphia, PA) are sold with instructions for conventional oven heating (22 to 30 minutes, 375 deg F.) Cooking for 1½ minutes at full power in a microwave oven produced no crisping or browning. Fish sticks were then wrapped in a composite material according to this invention, Type 1800 fiberglass fabric (16×14 count, 12 mil thick, 9.6 oz/sq.yd) radio frequency sputtered to deposit "Permalloy" (same as in Example 1) with an equivalent thickness of 750 angstroms as measured with a quartz crystal oscillator gauge. The wrapped fish sticks were placed on the top of a U-shaped cardboard paper support 3 cm above the glass tray at the bottom of the microwave oven. Cooking for 90 seconds at full microwave power produced uniformly browned and crisped fish sticks. The surface temperature of the composite material reached 140 deg C. No rotating table was needed. It is believed that the observed uniform browning/crisping is possible because of the use of a dual mode microwave susceptor material which heats similarly in both the E-field and H-field.

EXAMPLE 3

A full size frozen eggroll (1⅜" diameter, 4½" long) was cooked at "high" power in a Sharp Carousel II microwave oven with a built in rotating table for three minutes. Despite the use of the rotating table, the cooked egg roll's skin was mostly soggy with one overheated strip about ⅓" wide and 1½" from one end. Subsequently, the same type of eggroll was wrapped in a composite material of this invention, fiberglass fabric (as in Example 2) vacuum deposited with 120 ohm/square equivalent of stainless steel 304, and cooked at "high" power in the same microwave oven for three minutes. The eggroll so cooked had a uniformly crisped surface, a moist interior and did not have any overheated portions as did the egg roll cooked without a wrapping of composite material.

EXAMPLE 4

This example illustrates that molasses can be used as a susceptor material in the composite materials of this invention. Molasses (Brer Rabbit Green Label, Dark Full Flavored, New Orleans Style, All Natural Dark Molasses, distributed by Del Monte Corporation, San Francisco, Calif.) was coated onto paper in varying amounts. The temperature of the resulting composite materials after exposure for four minutes to a parallel electric field maximum at 242 V/cm (E || Field Temperature) and to a perpendicular magnetic field standing wave maximum at 0.521 Amp/cm (H⊥ Field Temperature) are presented in Table 4.

TABLE 4

| Molasses Coating Weight* | E \|\| Field Temperature** | H ⊥ Field Temperature** | $T_H - T_E/T_E$ Percent |
|---|---|---|---|
| 33.2 | 111 | 123 | +10.8 |
| 42.5 | 141 | 140 | −0.7 |
| 115.9 | 167 | 163 | −2.4 |

*in mg/sq.cm
**in degrees C.

EXAMPLE 5

A composite material was prepared by coating onto 92-gage polyester film a solution of circular aluminum flakes ("Y" flake, available from Kansai Paint Company, Hiratsuka, Japan) and polyester copolymer matrix in tetrahydrofuran. The total solids of the coating solution was 35%, with 60% of the coating solids being aluminum. A slot coater was used to coat the solution, in three passes, onto the polyester film to a dry coating thickness of 2.7 mils. On exposure to parallel E-field standing wave maximum (242 Volt/cm) for four minutes, the composite material reached a temperature of 228 degrees C.; on exposure to perpendicular H-field standing wave maximum (0.521 amp/cm) for four minutes, the composite material reached a temperature of 220 degrees C. The value for $((T_H-T_E)/T_E)*100\%$ was −3.5%.

What is claimed is:

1. Composite materials for wrapping around a food item to be cooked by microwave energy comprising a dielectric substrate substantially transparent to microwave energy which substrate is coated and/or imbibed with one or more microwave susceptor materials selected from mixtures of electrically conductive and magnetically permeable materials and from alloys of electrically conductive and magnetically permeable metals, the amount of said susceptor material or materials being adequate to allow said materials to absorb a portion of both the electric and the magnetic components of said microwave energy and convert said energy to heat so as to rapidly brown or crispen the surface of the food item adjacent thereto without substantially impeding the ability of the microwave energy to penetrate the susceptor material and cook the food item.

2. Composite materials of claim 1 which, when exposed for a given time period to a magnetic field standing wave maximum of 0.521 ampere/cm root mean square perpendicular to their surface, heat to a temperature $T_H$, and when exposed for the same time period to an electric field standing wave maximum of 242 volts/cm root mean square parallel to their surface, heat to a temperature $T_E$, where $((T_H-T_E)/T_E)*100\%$ is in the range from about −10 to +100%.

3. Composite materials of claim 2 where $((T_H-T_E)/T_E)*100\%$ is in the range from about −10 to +60%.

4. A method of cooking a food item with microwave energy and achieving browning and/or crispening of the surface of said food item by microwave energy comprising wrapping said food item in a composite material of claim 3 in such a way that said composite material conforms substantially to the shape of said food item and is substantially in contact with that portion of the surface of said food item which is desired to be browned and/or crispened, exposing the wrapped food item to the microwave energy and subjecting the surface of the food item, which is substantially in contact with the composite material, to heat generated by both the electric field and magnetic field of said microwave energy.

5. Composite materials of claim 2 where said susceptor material is an alloy selected from stainless steel, nickel/iron/molybdenum alloys and nickel/iron/copper alloys.

6. Composite materials of claim 2 where said susceptor material is a mixture of one or more electrically conductive materials and one or more magnetically permeable materials wherein sad electrically conductive materials and said magnetically permeable materials are in separate layers on said substrate.

7. A method of cooking a food item with micorwave energy and achieving browning and/or crispening of the surface of said food item without impeding the cooking of the food item by microwave energy comprising wrapping said food item in a composite material of claim 2 in such a way that said composite material conforms substantially to the shape of said food item and is substantially in contact with that portion of the surface of said food item which is desired to be browned, exposing the wrapped food item to the microwave energy and subjecting the surface of the food item, which is substantially in contact with the composite material, to heat generated by both the electric field and magnetic field of said microwave energy.

8. Composite materials of claim 1 where said susceptor material is an alloy selected from stainless steel, nickel/iron/molybdenum alloys and nickel/iron/copper alloys.

9. A method of cooking a food item with microwave energy and achieving browning and/or crispening of the surface of said food item without impeding the cooking of the food item by micowave energy comprising wrapping said food item in a composite material of claim 8 in such a way that said composite material conforms substantially to the shape of said food item and is substantially in contact with that portion of the surface of said food item which is desired to be browned and/or crispened, exposing the wrapped food item to the microwave energy and subjecting the surface of the food item, which is substantially in contact with the composite material, to heat generated by both the electric field and magnetic field of said microwave energy.

10. Composite materials of claim 1 where said susceptor material is a mixture of one or more electrically conductive materials and one or more magnetically permeable materials wherein said electrically conductive materials and said magnetically permeable materials are in separate layers on said substrate.

11. A method of cooking a food item with microwave energy and achieving browning and/or crispening of the surface of said food item without impeding the cooking of the food item by microwave energy comprising wrapping said food item in a composite material of claim 1 in such a way that said composite material conforms substantially to the shape of said food item and is substantially in contact with that portion of the surface of said food item which is desired to be browned and/or crispened, exposing the wrapped food item to the microwave energy and subjecting the surface of the food item, which is substantially in contact with the composite material, to heat generated by both the electric field and magnetic field of said microwave energy.

12. Composite materials for wrapping around a food item to be cooked by microwave energy comprising a dielectric substrate substantially transparent to microwave energy which substrate is coated and/or imbibed with one or more microwave susceptor materials selected from electrically conductive, non-magnetic materials, the amount of said susceptor material or materials being adequate to allow said materials to absorb a portion of both the electric and the magnetic field components of said microwave energy and convert said energy to heat to rapidly brown or crispen the surface of the food item adjacent thereto without substantially impeding the ability of the microwave energy to penetrate the susceptor material and cook the food item and which composite materials, when exposed for a given time period to a magnetic field standing wave maximum of 0.521 ampere/cm root mean square perpendicular to their surfaces, heat to a temperature $T_H$, and when exposed for the same time period to an electric field standing wave maximum of 242 volts/cm root means square parallel to their surfaces, heat to a temperature $T_E$, where $((T_H-T_E)/T_E)$ *100% is in the range from about −10 to +100%.

13. Composite materials of claim 12 where $((T_H-T_E)/T_E)$ *100% is in the range from about −10 to +60%.

14. Composite materials of claim 12 where said susceptor material is aluminum flake.

15. A method of cooking a food item with microwave energy and achieving browning and/or crispening of the surface of said food item without impeding the cooking of the food item by microwave energy comprising wrapping said food item in a composite material of claim 14 in such a way that said composite material conforms substantially to the shape of said food item and is substantially in contact with that portion of the surface of said food item which is desired to be browned and/or crispened, exposing the wrapped food item to the microwave energy and subjecting the surface of the food item, which is substantially in contract with the composite material, to heat generated by both the electric field and magnetic field of said microwave energy.

16. A method of cooking a food item with microwave energy and achieving browning and/or crispening of the surface of said food item without impeding the cooking of the food item by microwave energy comprising wrapping said food item in a composite material of claim 12 in such a way that said composite material conforms substantially to the shape of said food item and is substantially in contact with that portion of the surface of said food item which is desired to be browned and/or crispened, exposing the wrapped food item to the miceowave energy and subjecting the surface of the food item, which is substantially in contact with the composite material, to heat generated by both the electric field and magnetic field of said microwave energy.

17. Composite materials for wrapping around a food item to be cooked by microwave energy comprising a dielectric substrate substantially transparent to microwave energy which substrate is coated and/or imbibed with one or more susceptor materials selected from naturally occuring food substances, the amount of said susceptor material or materials being adequate to allow said materials to absorb a portion of both the electric and the magnetic components of said microwave energy and convert said energy to heat so as to rapidly brown or crispen the surface of the food item adjacent thereto without substantially impeding the ability of the microwave energy to penetrate the susceptor material and cook the food item.

18. Composite materials of claim 17 where said susceptor material is selected from molasses and maple syrup.

19. A method of cooking a food item with microwave energy and achieving browning and/or crispening of the surface of said food item without impeding the cooking of the food item by microwave energy comprising wrapping said food item in a composite material of claim 17 in such a way that said composite material conforms substantially to the shape of said food item and is substantially in contact with that portion of the surface of said food item which is desired to be browned and/or crispened, exposing the wrapped food item to the microwave energy and subjecting the surface of the food item, which is substantially in contact with the composite material, to heat generated by both the electric field and magnetic field of said microwave energy.

* * * * *